United States Patent [19]

Cowles

[11] Patent Number: 5,046,662

[45] Date of Patent: Sep. 10, 1991

[54] SELF-LOCKING CONTAINER

[75] Inventor: Dean E. Cowles, Fremont, Calif.

[73] Assignee: Inland Container Corporation, Indianapolis, Ind.

[21] Appl. No.: 608,259

[22] Filed: Nov. 2, 1990

[51] Int. Cl.[5] ..... B65D 5/10

[52] U.S. Cl. ..... 229/157; 229/156; 229/185

[58] Field of Search ..... 229/185, 156, 157, 195, 229/196

[56] References Cited

U.S. PATENT DOCUMENTS

| | | | |
|---|---|---|---|
| 3,067,924 | 12/1962 | Baker et al. | 229/157 |
| 3,539,090 | 11/1970 | Blasdell | 229/185 |
| 4,392,607 | 7/1983 | Perkins, Jr. | 229/157 |
| 4,702,408 | 10/1987 | Powlenko | 229/157 |
| 4,706,879 | 11/1987 | Cargile, Jr. | 229/155 |
| 4,821,949 | 4/1989 | Booth | 229/156 |

*Primary Examiner*—Stephen Marcus
*Assistant Examiner*—Chris McDonald
*Attorney, Agent, or Firm*—Fitch, Even, Tabin & Flannery

[57] ABSTRACT

A carton includes a tubular body with a pair of opposed sidewalls and a pair of opposed endwalls. A closure extending from the sidewalls and endwalls includes end panels and side panels joined to the endwalls and sidewalls with hinge lines. The end panels have a discontinuous free edge which extends across a pair of free corners. A recessed edge is located between the free corners and defines a pair of U-shaped locking edge portions on either side of a generally arcuate intermediate portion. A pair of locking recesses are formed in each side panel, each recess including an arcuate edge portion spanning a generally truncated V-shaped edge portion. The recessed edge of the end panels engages the locking recesses of the side panels to lock the carton closure.

7 Claims, 2 Drawing Sheets

SELF-LOCKING CONTAINER

BACKGROUND OF THE INVENTION:

1. Field of the Invention:

The present invention pertains to cartons, and in particular to cartons constructed from paper product such as paperboard and cardboard.

2. Description of the Related Art:

It is desirable, in many applications, to ship cartons in a "knocked-down" condition, preferably in the form of flat blanks stacked in palletized loads. When shipped to a user, the palletized loads are easily stored until needed. Thereafter, the carton blanks can be removed and erected as required.

In general, it is desirable that the carton blank be erected without requiring the use of adhesives or fasteners such as staples and the like, and users prefer carton blank designs where only a few simple folding operations are needed to fully erect a carton. From a load-carrying standpoint, the carton bottom construction is most critical and considerable attention has been paid over the years this aspect of foldable carton constructions.

It is known, for example, to provide a carton bottom construction with interlocking bottom flaps, where a corner or edge of one bottom flap is inserted in a minimally sized slit formed in an adjoining carton flap. Examples of such constructions are found in U.S. Letters Pat. Nos. 292,683; 490,167; 980,931; 1,997,660; 2,339,224; 2,990,993; and 4,367,840. At times, it is difficult to insert a carton flap into a slit in an adjoining carton panel, and attempts have been made to provide enlarged slits for receiving the corners or edges of an adjoining bottom closure flap. Examples of such constructions are given in U.S. Letters Pat. Nos. 2,361,603; 3,074,613; 3,178,096; 4,279,377; 4,279,379; 4,291,827; 4,614,298; and 4,702,408.

Enlarging the slots on carton bottom panels made it easier to insert adjacent flaps therein. However, concerns were raised that the retention ability of the resulting carton bottom constructions would be compromised. Attempts have been made to improve the locking retention of carton bottom constructions having enlarged slots for receiving the edges or corners of adjacent carton bottom panels. For example, U.S. Letters Pat. No. 4,650,112 provided enlarged L-shaped slots on the major-sized carton bottom panels The minor flaps of the carton bottom have a central, rectangular cutout forming locking legs at the corners of the minor flap. The legs are inserted into the L-shaped slot and engage one side of the slot, to provide flap retention. A similar flap retention is provided in U.S. Letters Pat. No. 4,821,949 and Austria Pat. No. 218,420.

Despite such developments in carton bottom constructions, improvements are constantly being sought. For example, U.S. Letters Pat. Nos. 4,650,112 and 4,821,949 provided score lines on the carton flap carrying the locking legs to facilitate insertion of the legs in a locking slot or a slit formed in an adjacent carton bottom panel. The legs provided for locking are disposed at corners of a carton bottom flap, and are separated by an intervening generally rectangular cutout portion. The legs located at the corners of the carton flap are prone to bending, resulting in a reduced area of contact between the locking legs and the carton flaps receiving those legs. It is desired to make such legs stronger and to more efficiently use the material in that portion of the carton blank allocated to the locking legs.

It is desirable to form the locking portions of a carton bottom panel in an economical manner, so as to maximize the usefulness of the carton material employed in locking the carton bottom. For example, U.S. Pat. No. 4,702,408 provides locking flaps with pairs of spaced apart generally truncated V-shaped notches, defining locking corners. The locking portions are received in rectangular openings formed in adjacent carton flaps, oriented along diagonals of the carton bottom. The locking portions of the mating flaps are generally arranged at angles to one another, with a reduced area of contact, reducing the efficient use of the material used in the interlocking member. The same problems are experienced in the collapsible box of U.S. Letters Pat. No. 2,361,603 which utilizes generally truncated triangular notches in one locking panel, receivable in diagonal slits expanded to form an arcuate edge. I is desirable to improve the design of carton locking members so as to more efficiently use the material of the interlocking components.

These and other objects according to the present invention, which will become apparent from studying the appended description and drawings, are provided in a carton apparatus comprising a tubular body with a pair of opposed sidewalls and a pair of opposed endwalls, and at least one closure extending from the sidewalls and endwalls so as to form at least a partially enclosed interior therewith. The closure comprises:

end panels joined to the endwalls with a hinge line so as to be foldable into a common plane;

the end panels each having a discontinuous free edge remote from the hinge line and a pair of free corners remote from the hinge line and extending from the free edge, the end panels further comprising a fold line between the free edge and the hinge line so as to divide the end panels into two parts to allow the part carrying the free edge to be swung out of the plane of the other end panel part;

the end panels including a recessed edge located between the free corners of the end panels and extending adjacent the end panel free edge, the recessed edge including a pair of spaced, generally U-shaped locking edge portions extending from the end panel free edge and a generally arcuate intermediate portion disposed therebetween, with the U-shaped locking edge portions defining a pair of opposed, generally arcuate panel-receiving slits;

the U-shaped locking edge portions cooperating with the end panel free edge to define a pair of opposed locking ears extending toward one another, one on either side of the intermediate arcuate edge portion;

side panels joined to the sidewalls with a hinge line so as to be foldable toward the common plane;

a pair of locking recesses formed in each side panel, each recess including an arcuate edge portion having an exterior end adjacent the sidewall hinge line and an interior end remote therefrom, and a generally truncated V-shaped edge portion extending generally between the interior and exterior ends of said arcuate recess edge, with a part of the truncated V-shaped edge immediately adjacent the interior end comprising a locking edge which is matingly engageable with the U-shaped locking edge portions of the end panels, and with the truncated V-shaped edge portions of a side panel extending toward one another with adjacent converging ends; and the side panels and end panels foldable toward a common plane, with the locking tabs of the end panel deflecting the hinge tabs into the interior of the carton to form recesses in the side panels into which the locking tabs are inserted so that the locking edge of the tab engages the locking edge of the side panels.

BRIEF DESCRIPTION OF THE DRAWINGS

In the drawings, wherein like elements are referenced alike.

DETAILED DESCRIPTION OF THE PREFERRED EMBODIMENT

Figure 1:
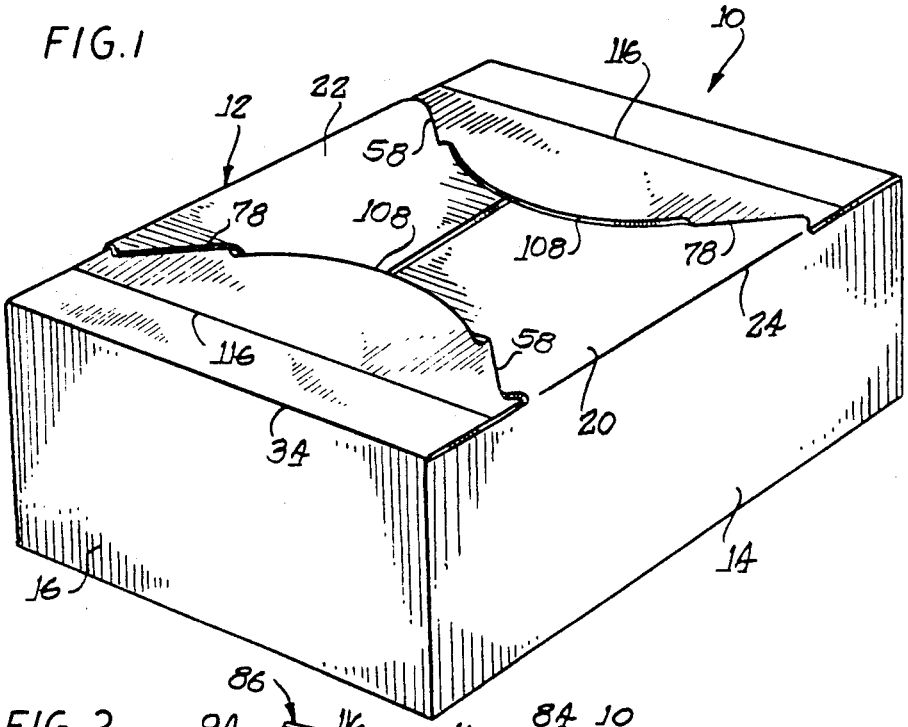
FIG. 1 is a perspective view of a carton, inverted to show a locking bottom illustrating aspects according to the present invention.
Figure 2:
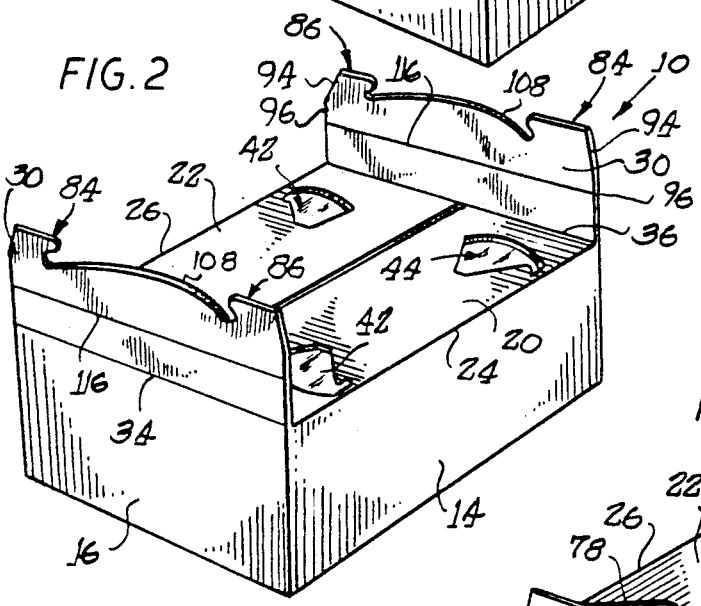
FIG. 2 is a perspective view of the carton of FIG. 1, on a reduced scale, showing the end flaps in a raised position.

Referring now to the drawings, and initially to FIGS. 1–4, a carton is generally indicated at 10. The carton is shown in an inverted position such that the carton bottom thereof, generally indicated at 12, is visible. Carton 10 includes sidewalls 14 and endwalls 16 arranged in pairs to enclose a generally rectangular carton interior. The carton bottom 12 of the preferred embodiment has four interlocking bottom closure flaps. The side flaps 20, 22 are secured to the sidewalls 14 by fold or hinge lines 24, 26, respectively. The end panels 30 are secured to the respective endwalls 16 with fold lines 34, 36.

Figures 4, 5, 6, 7:
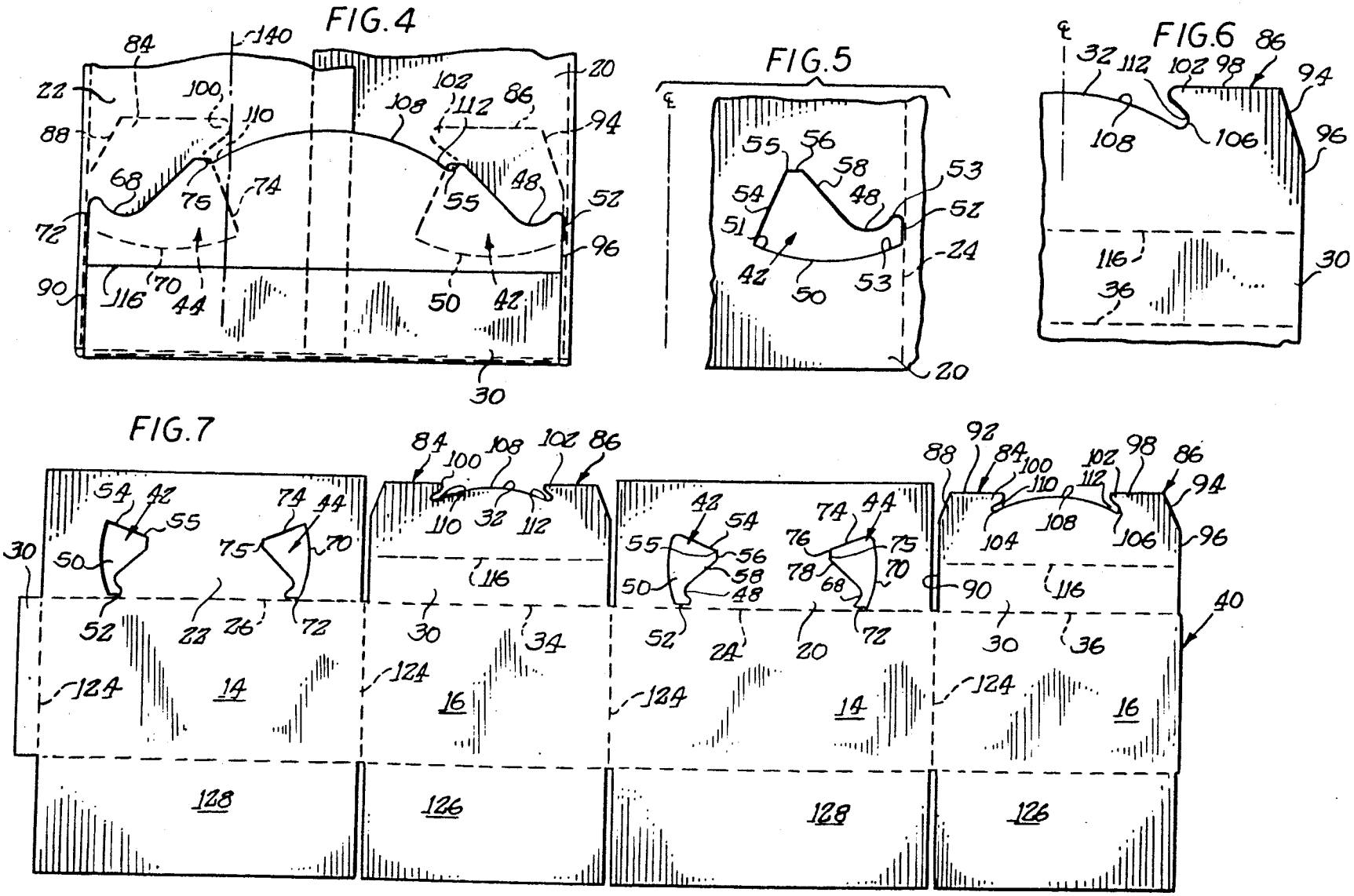
FIG. 4 is a fragmentary plan view of one end of the fully assembled carton of FIG. 1.
FIG. 5 is a fragmentary plan view of a side flap.
FIG. 6 is a fragmentary plan view of an end flap.
FIG. 7 is a plan view of a carton blank from which the carton of the preceding figures is constructed.

FIG. 7 shows a carton blank generally indicated at 40 from which carton 10 is formed. As can be seen in FIG. 5, the side flaps 20, 22 are generally identical and define locking recesses adjacent the fold lines 24, 26. The end panels 30 are generally identical to one another and define locking tabs at the corners thereof to be received in the locking recesses of the side flaps.

The locking recesses 42, 44 of each side panel have the shape of an irregular polygon comprising a series of two arcuate and four straight edges. The locking recesses 42, 44 are preferably mirror images of one another. The locking recess 42, for example, has rounded edges 48, 50 joined at one end to a straight edge 52 located adjacent fold line 24. The rounded edge 48 has interior and exterior ends 51, 53, respectively, with the exterior end 53 located adjacent the fold line 24. The opposed ends of curved edges 48, 50 are joined by straight edges 54, 56 and 58 which together form a truncated V-shaped edge portion of the recess 42, which converges at edge 56.

The locking recess 44 is similarly configured, having rounded edges 68, 70 and an intermediate straight edge 72 adjacent fold line 24. Straight edges 74, 76 and 78, which also form a truncated V-shaped edge portion, join the other ends of the curved edges.

If desired, the truncated V-shaped edge portions can be made to extend to the ends of the rounded edges 50, 70, the edges 48, 68 being optional.

The end panels 30 each have a discontinuous free edge with spaced free edge portions 92, 98, interrupted by a recessed portion forming a pair of locking tabs, designated by reference numerals 84, 86. The locking tab 84, for example, has an angled free corner 88 extending from the edge 90 of end panel 30 to the recessed portion. Locking tab 84 further includes a leading free edge portion 92 which preferably extends along one free edge of blank 40. Similarly, locking tab 86 has an angled free corner 94 extending from edge 96 of end panel 30 to the opposite end of the recessed portion. The term "angled corner" as used herein refers to the oblique angle formed between edges 94, 98. Of course, the edge 94 could also be rounded to achieve the same effects, as will be explained herein. The leading free edge portion 98, like edge portion 92, extends along an outer peripheral edge of blank 40, the leading free edge portions 92, 98 being colinear and extending along the discontinuous free edges of the end panels 30.

The recessed portions of the end panels are formed by recessed edges 32, which extend from the end panel free edge portions 92, 98 and which cooperate with the free corners of the end panels to form the locking tabs 84, 86. The recessed edges 32 each include a pair of spaced U-shaped locking edge portions 110, 112 formed on either side of a generally arcuate, convex edge 108. The locking edge portions 110, 112 cooperate with the end panel free edge portions 92, 98, respectively to form opposed locking ears 100, 102. The locking edge portions 110, 112 include intermediate bight portions 104, 106. The locking edge portions 110, 112 link the locking ears 100, 102 and convex edge 108.

Figure 3:
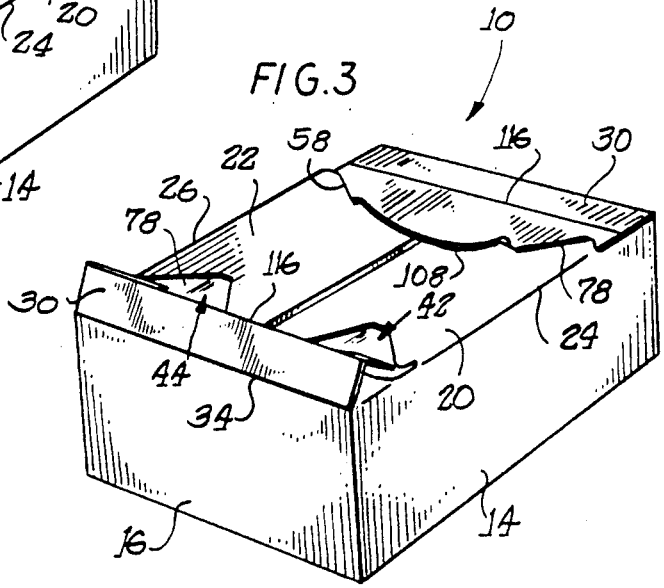
FIG. 3 is a perspective view of the carton of FIG. 1 shown in a partial stage of assembly.

Preferably, both end panels 30 are of identical construction, and both include the same locking tabs 84, 86. The end panels 30 further include fold lines 116 between the hinge lines 34, 36 and the end panel free edges. The fold lines 116 divide the end panels into two parts, one part carrying the locking tabs. The fold lines 116 allow the end panel parts to be folded into separate planes, to facilitate insertion, as illustrated in FIG. 3.

Referring again to FIG. 7, carton blank 40 includes fold lines 124 joining the sidewalls 14 and endwalls 16. For purposes of illustration, carton blank 40 is shown with generally rectangular upper flaps including end flaps 126 and side flaps 128. Flaps of other configurations or the same novel locking configurations disclosed herein could, of course, be used at the top end of carton 10. A joint flap 130 extends from one sidewall panel 14 and, when the carton is assembled, is affixed with adhesive to end panel 16 at the opposite end of carton blank 40, as is known in the art.

As can be seen in FIG. 4, for example, the side panels 20, 22 are dimensioned so as to partially overlap one another when the carton is constructed. This provides a dust-proof sealing for the carton bottom, but the present invention also contemplates side panels which do not overlap, but which meet at a center line of the carton or are slightly spaced apart from one another when the carton bottom is assembled.

Carton 10 is assembled by folding the sidewalls 14 and endwalls 16 into a tubular form, as is known in the art, and securing the joining tab 130 to endwalls 16 with a suitable adhesive. The bottom closure 12 is then assembled by folding sidewall 20 to form a generally right angle with sidewall 14, by bending about fold line 24. Next, the other sidewall 22 is folded so as to partially overlie sidewall 20, in the manner illustrated in FIG. 4. Next, the end panels 30 are bent about their fold lines 116 in the manner illustrated in FIG. 3, with respect to flap 30. Thereafter, the locking recesses 84, 86 are guided into their respective locking tabs 44, 42, respectively, with bight portions 104, 106 engaging recess edges 74 and 54 respectively. FIG. 4 shows the carton bottom in a fully locked condition with the corners 55, 75 of the locking recesses 42, 44, engaging the locking edges 112, 110, respectively. The locking engagement has been found to provide an improved retention of the side and end flaps, compared to previous designs.

The bottom closure of the carton constructed according to principles of the present invention attains many other advantages, which will now be described. As can be seen in FIG. 4, the concave edge 108 of end flap 30 presses against side flaps 20, 22 being held in pressing engagement therewith, by the locking tabs 84, 86 which are bent slightly out of the plane of end flap 30. It has been found that bending of locking tabs 84, 86 to allow insertion into side flaps 20, 22 creates a bias force in the locking tabs, tending to restore their coplanar alignment with the remainder of flap 30. This creates a pressure or pinching effect with concave edge 108 which tends to maintain side panels 22, 20 in a fully closed position, with the dust-proof sealing at the overlap of the side flaps being maintained thereby.

As mentioned previously, each locking tab has an angled corner formed adjacent the tab leading edge. For example, locking tab 84 has an angled corner 88 and locking tab 86 has an angled corner 94. These angled corners provide a relief to reduce friction and binding at the edges 52, 72 of locking recesses 42, 44 during insertion of the locking tabs. As shown in FIG. 4, the side edges 90, 96 fit tightly against the recess edges 72, 52, respectively. The angled corners 88, 94 defer the close fit engagement during assembly, until the locking tabs are well advanced within recesses 42, 44.

As mentioned above, the locking recesses 42, 44 preferably include curved edges 48, 68, respectively. As can be seen in FIG. 4, these curved edges extend toward fold line 116, pressing against side panels 20, 22 to further aid in maintaining the above-described pinching effect. Further, the projections 48, 68, at their points of closest extension to fold line 116, exert a pressure or buckling force on the locking tabs which augments the pressure of the locking tabs against side panels 20, 22.

A reference line 140 extends from the tip or innermost extent of locking ear 100. As can be seen in FIG. 4, line 140 intersects edge 74 of recess 44 at a mid portion thereof, thus indicating clearance of the locking tab with respect to edge 74, during initial insertion of the tab into recess 44. At this point in the construction of the carton bottom, the concave edge 108 is slid along the surface of side panel 22. The sliding occurs with a point contact, or at most, a very short line contact of edge 108, thus reducing frictional forces which might hinder an operator during assembly of the carton bottom, further augmenting a seemingly "automatic" erection of the carton bottom.

According to other aspects of the present invention, edges of the interlocking carton bottom components are rounded to greatly increase their resistance to tearing, even when placed under considerable load from within the carton. For example, the locking edges of the locking tabs are rounded at 104, 106 at their point of final engagement with the corners 55, 75 of flaps 20, 22. Also, a rounded edge portion 53 connects curved edge 48 with straight edge 52 of carton flap 20, thus reducing risk of tearing when edges 96 of end panels 30 ride against edges of the locking recess. Further, the rounded edges 50, 70 aid in augmenting the buckling force of protrusions 48, 68 offering an improvement over a straight line, right angled recess, for example.

The angled corners 88, 94 provide a feed-in clearance during initial stages of the carton bottom construction, thus making the carton more tolerant to dimensional variations as might occur in a practical manufacture and assembly of commercial carton blanks. Thus, the carton constructed according to the present invention offers advantages for very large production runs, where carton blanks are subjected to slight dimensional changes as the cutting dies and folding mechanisms "wear in" or otherwise undergo slight variations from one production run to another. It will be noted, however, that despite the feed-in clearances, the above mentioned locking engagement of the locking tabs and recesses is not compromised.

Further, the optional rounded shape of curved edges 48, 68 reduces the contact area with the surfaces of end panel 30 and reduces the likelihood that portions of panel 30 might catch or become bound during entry of the locking tabs into the recesses 42, 44. This optional feature is advantageous, since, during initial stages of the carton assembly, the rounded edges 48, 68 are the first to engage the locking tabs of the end panels. Further, as will be noted in the drawings, the rounded edges 48, 68 extend from the major body portions of side panels 20, 22. Thus, the rounded edges 48, 68 are free to flex slightly during insertion of the locking tabs, further reducing binding of the flaps during insertion.

As can also be seen in FIG. 4, the locking ears 100, 102 provide a lateral overlap with side panels 20, 22. That is, the locking ears extend toward the mating edges of side panels 20, 22 where the side panels themselves overlap at the center of the carton bottom. This extension of the locking ears 100, 102 is in a direction generally perpendicular to the insertion direction, thus augmenting the positive locking of tabs 84, 86 in the locking recesses.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following Claims.

What is claimed is:

1. A carton apparatus comprising:

a tubular body with a pair of opposed sidewalls and a pair of opposed endwalls;

at least one closure extending from the sidewalls and endwalls so as to form at least a partially enclosed interior therewith, said at least one closure comprising:

end panels joined to the endwalls with a hinge line so as to be foldable into a common plane;

the end panels each having a discontinuous free edge remote from the hinge line and a pair of free corners remote from the hinge line and extending from the free edge, the end panels further comprising a fold line between the free edge and the hinge line so as to divide the end panels into two parts to allow the part carrying the free edge to be swung out of the plane of the other end panel part;

the end panels including a recessed edge located between the free corners of the end panels and extending adjacent the end panel free edge, the recessed edge including a pair of spaced, generally U-shaped locking edge portions extending from the end panel free edge and a generally arcuate intermediate portion disposed therebetween, with the U-shaped locking edge portions defining a pair of opposed, generally arcuate panel-receiving slits;

the U-shaped locking edge portions cooperating with the end panel free edge to define a pair of opposed locking ears extending toward one another, one on either side of the intermediate arcuate edge portion;

side panels joined to the sidewalls with a hinge line so as to be foldable toward the common plane;

a pair of locking recesses formed in each side panel, each recess including an arcuate edge portion having an exterior end adjacent the sidewall hinge line and an interior end remote therefrom, and a generally truncated V-shaped edge portion extending generally between the interior and exterior ends of said arcuate recess edge, with a part of the truncated V-shaped edge immediately adjacent the interior end comprising a locking edge which is matingly engageable with the U-shaped locking edge portions of the end panels, and with the truncated V-shaped edge portions of a side panel extending toward one another with adjacent converging ends; and the side panels and end panels foldable toward a common plane, with the locking tabs of the end panel deflecting the hinge tabs into the interior of the carton to form recesses in the side panels into which the locking tabs are inserted so that the locking edge of the tab engages the locking edge of the side panels.

2. The apparatus of claim 1 wherein the corners of each end panel are angled, forming an oblique angle with the end panel free edge.

3. The apparatus of claim 2 wherein each locking recess includes a concave edge portion joining the exterior ends of the arcuate and truncated V-shaped edge portions, the concave edge portions opening in the same direction as the arcuate edge portions of the locking recesses.

4. The apparatus of claim 1 wherein the locking ears have rounded tips at their point of closest extension to one another.

5. The apparatus of claim 1 wherein said carton includes two closures, on opposite ends of the sidewalls and endwalls.

6. The apparatus of claim 1 wherein the arcuate edge portion has a midpoint which lies along a line extending along said end panel discontinuous free edge.

7. A carton blank comprising:

an alternating series of sidewalls and endwalls;

end panels joined to the endwalls with respective hinge lines;

the end panels each having a discontinuous free edge remote from the hinge line and a pair of free corners remote from the hinge line and extending from the free edge, the end panels further comprising a fold line between the free edge and the hinge line so as to divide the end panels into two parts to allow the part carrying the free edge to be swung out of the plane of the other end panel part;

the end panels further having a recessed edge located between the free corners of the end panels, adjacent the end panel free edge, the recessed edge including a pair of spaced U-shaped locking edge portions extending from the end panel free edge and a generally arcuate intermediate portion disposed therebetween, with the U-shaped locking edge portions defining a pair of opposed, generally arcuate panel-receiving slits;

the U-shaped locking edge portions cooperating with the end panel free edge to define a pair of opposed locking ears extending toward one another, one on either side of the intermediate arcuate edge portion;

side panels joined to the sidewalls with respective hinge lines;

a pair of locking recesses formed in each side panel, each side panel including a pair of opposed arcuate edge portions, each having an exterior end adjacent the sidewall hinge line and an interior end remote therefrom, and a pair of generally truncated V-shaped edges extending toward one another with adjacent converging ends, the truncated V-shaped edges extending generally between the interior and exterior ends of a respective arcuate recess edge, with parts of the truncated V-shaped edges immediately adjacent the interior ends comprising a locking edge matingly engageable with the U-shaped locking edge portions of the end panels; and the side panels and end panels foldable toward a common plane, with the locking tabs of the end panel deflecting the hinge tabs into the interior of the carton to form recesses in the side panels into which the locking tabs are inserted so that the locking edge of the tab engages the locking edge of the side panels.

* * * * *

UNITED STATES PATENT AND TRADEMARK OFFICE

CERTIFICATE OF CORRECTION

PATENT NO. : 5,046,662

DATED : September 10, 1991

INVENTOR(S) : Dean Cowles

It is certified that error appears in the above-identified patent and that said Letters Patent is hereby corrected as shown below:

In Column 1, line 31, change "1,997,660" to read --1,997,667--.

In Column 1, line 49, after the word "panels" insert a period --.--.

In Column 2, line 20, change "I" to read --It--.

In Column 2, lines 59-60, delete the paragraph separating "adjacent" and "the sidewall".

Signed and Sealed this

Fifth Day of January, 1993

*Attest:*

DOUGLAS B. COMER

*Attesting Officer*

*Acting Commissioner of Patents and Trademarks*